US007816975B2

(12) United States Patent
Zhou et al.

(10) Patent No.: US 7,816,975 B2
(45) Date of Patent: Oct. 19, 2010

(54) CIRCUIT AND METHOD FOR BIAS VOLTAGE GENERATION

(75) Inventors: Dacheng Zhou, Fort Collins, CO (US); Jeffry Yetter, Loveland, CO (US); Daniel A. Berkram, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 939 days.

(21) Appl. No.: 11/230,786

(22) Filed: Sep. 20, 2005

(65) Prior Publication Data

US 2007/0063687 A1 Mar. 22, 2007

(51) Int. Cl.
*G05F 1/10* (2006.01)

(52) U.S. Cl. ..... 327/538

(58) Field of Classification Search ..... None
See application file for complete search history.

(56) References Cited

U.S. PATENT DOCUMENTS

| | | | |
|---|---|---|---|
| 4,342,926 | A | 8/1982 | Whattley |
| 6,111,445 | A | 8/2000 | Zerbe et al. |
| 6,198,339 | B1 | 3/2001 | Gersbach et al. |
| 6,329,859 | B1 | 12/2001 | Wu |
| 6,359,486 | B1 | 3/2002 | Chen |
| 6,384,653 | B1 | 5/2002 | Broome |
| 6,466,098 | B2 | 10/2002 | Pickering |
| 6,509,773 | B2 | 1/2003 | Buchwald et al. |
| 6,525,584 | B2 | 2/2003 | Seo et al. |
| 6,570,425 | B2 | 5/2003 | Yamaguchi |
| 6,597,212 | B1 | 7/2003 | Wang et al. |
| 6,646,512 | B2 | 11/2003 | Abassi et al. |
| 6,791,388 | B2 | 9/2004 | Buchwald et al. |
| 6,856,661 | B2 | 2/2005 | Cho |
| 6,900,681 | B2 | 5/2005 | Takano |
| 2002/0036532 | A1 | 3/2002 | Chen |
| 2002/0039394 | A1 | 4/2002 | Buchwald et al. |
| 2002/0053931 | A1 | 5/2002 | Yamaguchi |
| 2002/0125960 | A1 | 9/2002 | Pickering |
| 2002/0126786 | A1 | 9/2002 | Cho |
| 2003/0002596 | A1 | 1/2003 | Dunning et al. |

(Continued)

FOREIGN PATENT DOCUMENTS

| | | |
|---|---|---|
| DE | 695 13 185 | 11/1990 |

(Continued)

OTHER PUBLICATIONS

Phase Interpolator; Serial IO Interpolator Discussion; http://iram.cs.berkeley.edu/serialio/cs254/interpolator/interp.html; May 26, 2005.

(Continued)

*Primary Examiner*—Lincoln Donovan
*Assistant Examiner*—Khareem E Almo

(57) ABSTRACT

A bias voltage generation circuit is provided which includes a voltage-to-current translation circuit configured to generate a first current that is positively related to a first voltage. A current mirror circuit is configured to generate a first bias voltage that is negatively related to the first current. The current mirror circuit also generates a second current that is positively related to the first current. Also employed is a current-to-voltage translation circuit configured to generate a second bias voltage that is positively related to the second current.

26 Claims, 11 Drawing Sheets

U.S. PATENT DOCUMENTS

| | | | | |
|---|---|---|---|---|
| 2003/0002607 | A1 | 1/2003 | Mooney et al. | |
| 2003/0006817 | A1 | 1/2003 | Seo et al. | |
| 2003/0122588 | A1 | 7/2003 | Glenn | |
| 2003/0123589 | A1 | 7/2003 | Glenn et al. | |
| 2003/0123594 | A1 | 7/2003 | Glenn et al. | |
| 2003/0141914 | A1 | 7/2003 | Buchwald et al. | |
| 2003/0165209 | A1 | 9/2003 | Chen et al. | |
| 2004/0027158 | A1 | 2/2004 | Schoch | |
| 2004/0027194 | A1 * | 2/2004 | Morishita et al. | 327/543 |
| 2004/0057546 | A1 | 3/2004 | Badets et al. | |
| 2004/0169539 | A1 | 9/2004 | Gauthier et al. | |
| 2004/0189363 | A1 | 9/2004 | Takano | |
| 2004/0212416 | A1 | 10/2004 | Buchwald et al. | |
| 2005/0024117 | A1 | 2/2005 | Kubo et al. | |
| 2005/0040883 | A1 * | 2/2005 | Saitoh | 327/541 |
| 2005/0218970 | A1 * | 10/2005 | Kawai et al. | 327/543 |
| 2005/0248389 | A1 * | 11/2005 | Nguyen | 327/538 |
| 2005/0248392 | A1 * | 11/2005 | Jung | 327/541 |
| 2006/0164152 | A1 * | 7/2006 | Tschanz et al. | 327/530 |

FOREIGN PATENT DOCUMENTS

| | | |
|---|---|---|
| DE | 199 49 782 | 7/2001 |
| EP | 0 397 408 | 11/1990 |

OTHER PUBLICATIONS

Fine Phase Interpolator; http://mos.stanford.edu/ee272/proj01/dual-loop/node12.html; May 26, 2005.

DE Office Action, English translation, dated Jul. 27, 2007, 3 pages.

* cited by examiner

CIRCUIT AND METHOD FOR BIAS VOLTAGE GENERATION

BACKGROUND OF THE INVENTION

In virtually all communication systems, data is transferred from a transmitting node of the communication system to a receiving node over a communication path. Such a path may be a wired or wireless connection between the communicating nodes. In many of these systems, the data take the form of a digital signal transferred at a substantially constant rate over the connection. Normally, the data signal presents a series of binary digits ("bits") that represent the digital information being transmitted to form a serial communication path. Further, several such series of bits transferred simultaneously may form a multi-channel, parallel communication connection.

Some communication systems also supply a data clock signal over the same connection to provide timing information for the data signal. Typically, the data signal is sampled, or "clocked," at each logic "low" to logic "high" transition of the data clock to identify each bit being transferred. However, other communication systems do not provide a clock signal along with the data signal over the connection, instead relying on the receiving node's knowledge of the transfer rate of the data signal to allow proper interpretation of the data signal.

Unfortunately, without a clock signal supplied by the transmitting node, drift of the data signal frequency, variations in the frequency of a local oscillator from which the data clock is derived, and similar problems may cause the receiving node to improperly clock the data signal. To counteract such problems, the receiving node is often equipped with a data clock recovery system to help ensure proper sampling of the data signal.

Typically, an important portion of such a data clock recovery system may be termed a phase generator, which is employed to continually adjust the phase of a locally-generated clock signal to properly align with the data signal for clocking purposes.

One example of a phase generator 1 is illustrated in FIG. 1. Generally, the phase generator 1 accepts as input a reference clock RCLK, a phase shift "up" signal PUP, and a phase shift "down" signal PDOWN. As is described in greater detail below, the reference clock RCLK is utilized to generate a higher-frequency data clock OUTCLK having two phases, OUTCLKP and OUTCLKN, separated in phase by 180 degrees. The phase of the sampling clock OUTCLK is adjusted according to the phase shift signals PUP and PDOWN. Typically, each pulse of the PUP signal causes the phase of the sampling clock OUTCLK to be advanced "up" some portion of a period, while a pulse of the PDOWN signal causes the phase of the sampling clock OUTCLK to be delayed "down" a similar amount. Typically, the PUP and PDOWN signals are generated by another portion of the data clock recovery system, often based upon a phase detector or similar device configured to determine the relative phase of the data signal and the data clock.

As seen in FIG. 1, the phase generator 1 includes a phase-locked loop (PLL) 20, a multiplexer 40, a phase interpolator 60, a thermometer code register 80, and a counter 90. The PLL 20 uses the reference clock RCLK to generate a multiphase clock to be provided to the multiplexer 40. In the particular example of FIG. 1, the PLL 20 generates eight equally-spaced phases P0 through P7, each of which is separated in phase from adjacent phases by 45 degrees. A timing diagram of the phases P0-P7 is shown in FIG. 2. Other PLLs may generate more or fewer clock phases, depending on the requirements of the particular application. Typically, 4, 8, or 16 clock phases are produced. In other examples of the phase generator 1, a delay-locked loop (DLL) may be employed in lieu of the PLL 20.

FIG. 3 provides a more detailed view of the PLL 20. The reference clock RCLK is received by a phase detector 21, which compares the phase of the reference clock RCLK with a low-frequency clock 28 described more fully below. As a result of this comparison, a phase advance signal 24 and a phase delay signal 25 are generated. The phase advance signal 24 indicates when the low-frequency clock 28 is required to be advanced in order to maintain its phase relationship with the reference clock RCLK. Conversely, the phase delay signal 25 becomes active when the phase detector 21 determines that the low-frequency clock 28 must be delayed to maintain its phase relationship with the reference clock RCLK.

A charge pump 22 receives and processes the phase advance signal 24 and the phase delay signal 25 to generate a control voltage signal 26 across a capacitor C. The capacitor C acts as a storage medium for the charge pump 22, thus exhibiting a voltage indicating whether the frequency of the low-frequency clock 28 should be increased or decreased to alter its phase relative to the reference clock RCLK. Additionally, the capacitor C often acts as a low-pass filter to affect how quickly the PLL 20 reacts to changes in the reference clock RCLK.

The control voltage signal 26 is received by a voltage-controlled oscillator (VCO) 30, which generates a high-frequency clock 27 whose frequency is determined by the voltage level of the control voltage signal 26. More specifically, the higher the voltage level of the control voltage signal 26, the higher the frequency of the high-frequency clock 27, and vice-versa. The frequency of the high-frequency clock 27 is then divided by a 1/N divider 23, where N is typically a power of 2, such as 16. In that case, a 100 megahertz (MHz) reference clock RCLK would be phase-locked with a 100 MHz low-frequency clock 28, which is turned is derived from a 16*100 MHz=1.6 gigahertz (GHz) high-frequency clock 27 generated by the VCO 30. Other values of N may be employed in the alternative.

In the PLL 20 of FIG. 3, the high-frequency clock 27 generated by the VCO 30 is actually one of the multiphase clock phases P0-P7, all of which are generated by the VCO 30. The PLL 20 thus serves primarily as a multiphase clock generator, which allows generation of a high-frequency multiphase clock from a single-phase, relatively low-frequency, reference clock RCLK. FIG. 4 depicts a particular example of the VCO 30 in greater detail. Four delay elements 32, labeled 32*a*-32*d*, form a ring oscillator used to generate the high-frequency clock 27 having a frequency controlled by the control voltage signal 26. More specifically, each delay element 32 receives an input biphase signal by way of a positive input INP and a negative input INN, and produces an output biphase signal composed of a positive output OUTP and a negative output OUTN. Each positive output OUTP of a particular delay element 32 thus produces a signal 180 degrees out of phase with its corresponding negative output OUTN. Given the arrangement of FIG. 4, each delay element 32 produces two of the eight phases P0-P7 of the multiphase clock shown in FIG. 2, wherein the two phases are out of phase by 180 degrees. For example, phases P0 and P4 may be produced by the first delay element 32*a*, phases P1 and P5 may be generated by the second delay element 32*b*, and so on.

The total time delay of a roundtrip about the oscillator ring is essentially equivalent to one-half the period of the high-frequency clock 27 and each of the clock phases P0-P7. This roundtrip delay is controlled, in turn, by the delay exhibited by each delay element 32. The delay of each delay element 32 is controlled in turn by the control voltage signal 26, which is processed by a bias voltage controller 31 to produce a positive bias control signal 34 and a negative bias control signal 36.

One particular example of a delay element 32 is provided in the simplified schematic diagram of FIG. 5. The gate of an n-channel metal-oxide-semiconductor field-effect transistor (MOSFET) $Q_{INP}$ is driven by the positive input INP of the delay element 32. As INP rises in voltage, $Q_{INP}$ tends to conduct current, causing its drain terminal, connected to the negative output OUTN, to drop in voltage. Conversely, when the voltage level of INP falls, OUTN rises. A second MOSFET $Q_{INN}$, whose gate is coupled with the negative input INN and whose drain is coupled with the positive output OUTP, operates in a similar fashion.

The propagation delay between the inputs INP, INN and the outputs OUTP, OUTN is determined in part by the negative bias control signal 36 from the bias voltage controller 31. The negative bias control signal 36 drives a MOSFET $Q_N$ to alter a bias current flowing through either of the input MOSFETS $Q_{INP}$, $Q_{INN}$. As the negative bias control signal 36 increases, the bias current tends to increase as well, and vice-versa.

Changing the bias current in such a fashion tends to alter the magnitude of the voltage swings experienced by the outputs OUTP, OUTN. To compensate for the change in bias current to maintain a relatively constant amplitude for the outputs OUTP, OUTN, the positive bias control signal 34 from the bias voltage controller 31 is utilized. The positive bias control signal 34 drives the gates of four p-channel MOSFETs $Q_{BP1}$-$Q_{BP4}$, configured as two active resistive loads, each of which is coupled with one of the outputs OUTP, OUTN and a drain voltage $V_{DD}$. Each of the loads is driven by the positive bias control signal 34 to alter the amount of resistive load imparted by $Q_{BP1}$-$Q_{BP4}$ upon the outputs OUTP, OUTN, thus generally controlling the delay exhibited by the delay element 32.

To maintain a substantially constant voltage amplitude for the outputs OUTP, OUTN, an increase in bias current due to an increase in the negative bias control signal 36 is typically matched with a commensurate voltage drop in the positive bias control signal 34. Such a drop in voltage reduces the resistive load imparted by $Q_{BP1}$-$Q_{BP4}$, which in turn reduces the time delay in voltage transitions at the outputs OUTP, OUTN due to a lower R-C time constant produced by the active resistive load and a load capacitance (not shown) at each of the outputs OUTP, OUTN. Reducing the time delay exhibited by each delay element 32 in such a manner results in an increase in the frequency of the clock phases P0-P7 and the high-frequency clock 27 generated by the VCO 30. Conversely, decreasing the bias current and increasing the active load of each of the delay elements 32 results in a reduction of the frequency of the clock phases P0-P7 and the high-frequency clock 27. Thus, the frequency of the clock phases P0-P7, which are typically set to match the expected data rate of a data signal being received, are primarily determined by the positive and negative bias control signals 34, 36 from the bias voltage controller 31.

FIG. 6 illustrates one particular simplified example of the bias voltage controller 31. In this case, two MOSFETS $Q_A$ and $Q_B$ are employed to generate the positive bias control signal 34 from the control voltage signal 26 of the charge pump 22 of the PLL 20. As the control voltage signal 26, which drives the gate of $Q_A$, increases, the level of electrical current through both $Q_A$ and $Q_B$ increases, thus lowering the voltage at the gate of $Q_B$, and hence the positive bias control signal 34. In the bias voltage controller of FIG. 6, the control voltage signal 26 is passed through as the negative bias control signal 36. Thus, as the negative bias control signal 36 increases, the positive bias control signal 34 decreases, and vice-versa, in accordance with the requirements of the delay element 32 discussed above, so that increases in the control voltage signal 26 result in increases in frequency of the clock phases P0-P7. Conversely, as the voltage level of the control voltage signal 26 decreases, so does the frequency of the clock phases P0-P7. Other circuits and methods not described herein have also been employed in other implementations of the bias voltage controller 31.

In one specific example of the bias voltage controller 31 and each delay element 32, the widths or sizes of the various FETs involved in generating the positive and negative bias control signals 34, 36 are controlled. More specifically, the ratio of the widths of $Q_N$ to $Q_A$ is essentially equal to the ratio of the widths of ($Q_{BP1}$+$Q_{BP2}$) (or $Q_{BP3}$+$Q_{BP4}$) to $Q_B$. Further, the widths of $Q_{BP1}$ and $Q_{BP2}$ are essentially equal, as are $Q_{BP3}$ and $Q_{BP4}$. Controlling the width ratios of the various FETs in such a manner helps ensure that the voltage levels of the positive and negative bias control signals 34, 36 relate to expected bias current levels and active resistive load values relative to the control voltage signal 26 for proper control of the frequency of the clock phases P0-P7.

Returning to FIG. 1, four clock phases, labeled CLKAP, CLKAN, CLKBP and CLKBN, are selected from the eight clock phases P0-P7 from the PLL 20 by way of the multiplexer 40 for ultimate delivery to the phase interpolator 60. Two of the four selected phases, CLKAP and CLKBP, are adjacent phases between which the desired output clock OUTCLK, as defined by the two output phases OUTCLKP and OUTCLKN, is situated. The third and fourth selected phases CLKAN and CLKBN are the negative phases of the first two phases, CLKAP and CLKBP. For example, in reference to FIG. 2, if P1 is selected as CLKAP, then CLKBP is P2, CLKAN is P5, and CLKBN is P6.

The selection of the four phases CLKAP, CLKAN, CLKBP and CLKBN is performed in FIG. 1 by way of a three-bit phase selection value PSEL(2:0) generated by the three-bit counter 90. The phase selection value PSEL(2:0) is incremented by a COUNTUP signal and decremented by a COUNTDOWN signal from the thermometer code register 80, which in turn is driven by the phase up and down signals, PUP and PDOWN, referenced above. The thermometer code register 80 produces a 32-bit thermometer code TC(31:0) employed by the phase interpolator 60 to generate the desired phase for the output clock OUTCLK between CLKAP and CLKBP. Other sizes for the thermometer code register 80, such as 16 bits, may be seen in other examples. If the desired phase advances out of the range between CLKAP and CLKBP, the thermometer code register 80 issues an indication on the COUNTDOWN signal to decrement the phase selection value PSEL. For example, if CLKAP is P1, a pulse or similar indication on the COUNTDOWN signal will shift CLKAP to P2, and the other three of the four selected phases CLKBP, CLKAN, CLKBN will be shifted accordingly. On the other hand, a COUNTUP pulse will shift CLKAP from P1 to P0, and the other phases CLKBP, CLKAN and CLKBN will be changed correspondingly.

FIG. 7 provides a simplified schematic diagram of the phase interpolator 60. Generally, each bit 'X' of the thermometer code TC(31:0) from the thermometer code register 80 drives a pair of n-channel MOSFETs $Q_{SX}$, $Q_{BX}$ configured to sink current when the corresponding thermometer code bit is active. For example, when thermometer code bit TC31 is active, the voltage at the gate terminal of $Q_{S31}$ is elevated, causing both $Q_{S31}$ and $Q_{B31}$ to conduct current through either of a pair of MOSFETs $Q_{AP}$ or $Q_{AN}$, depending on the state of the CLKAP and CLKAN signals. The MOSFETs $Q_{S31}$-$Q_{S0}$, $Q_{B31}$-$Q_{B0}$ thus collectively provide a current weighting circuit, wherein the MOSFETs $Q_{S31}$-$Q_{S16}$, $Q_{B31}$-$Q_{B16}$ associated with the most significant half of the thermometer code TC(31:16) provide current for $Q_{AP}$ and $Q_{AN}$ associated with CLKAP and CLKAN. Similarly, $Q_{S15}$-$Q_{S0}$ and $Q_{B15}$-$Q_{B0}$ identified with the least significant half of the thermometer code TC(15:0) provide current for the transistors $Q_{BP}$ and $Q_{BN}$ driven by CLKBP and CLKBN, respectively.

As shown by way of the timing diagram of FIG. 8, the current weighting circuit $Q_{S31}$-$Q_{S0}$, $Q_{B31}$-$Q_{B0}$, as driven by the thermometer code TC(31:0), determines the phase of the output clock phases OUTCLKP, OUTCLKN relative to CLKAP, CLKAN, CLKBP and CLKBN. Typically, a contiguous 16 bits of the thermometer code TC(31:0) are set to logic one, while the remainder are set to zero so that the total amount of current drawn through $Q_{AP}$, $Q_{AN}$, $Q_{BP}$ and $Q_{BN}$ remains substantially constant. The distribution of ones in the thermometer code TC(31:0) among its most and least significant halves determines the relative phase of the output clock phases OUTCLKP, OUTCLKN between CLKAP, CLKAN and CLKBP, CLKBN. More specifically, the more ones that reside within the most significant portion of the thermometer code TC(31:16), the closer the transitions of the output clock phases OUTCLKP, OUTCLKN are to those of CLKAP and CLKAN. Conversely, the more ones that reside within the least significant half of the thermometer code TC(15:0), the closer the transitions of the output clock phases OUTCLKP, OUTCLKN reside to the transitions of CLKBP and CLKBN. For example, as shown graphically in FIG. 8, a thermometer code TC(31:0) value (in hexadecimal notation) of $7FFF8000_H$ (in binary notation, $01111111111111111000000000000000_B$) results in transitions of the positive output clock phase OUTCLKP being positioned approximately 1/16 of the time delay between CLKAP and CLKBP after CLKAP. Similarly, a thermometer code TC(31:0) value of $0001FFFE_H$ ($00000000000000011111111111111110_B$) results in the positive output clock phase OUTCLKP transitions occurring 1/16 of the time delay between CLKAP and CLKBP before CLKBP. FIG. 8 shows other relationships between the location of the positive output clock phase OUTCLKP and the thermometer code TC(31:0). The negative output clock phase OUTCLKN makes its voltage transitions substantially at the same time as the positive output clock phase OUTCLKP.

Typically, for proper operation of the phase interpolator 60 of FIG. 7, the interpolator bias current and loading bandwidth should be set appropriately for the particular frequency range of the output clock OUTCLK. For example, the loading bandwidth and the bias current should be matched with the output clock OUTCLK frequency so that full voltage swing of the output clock OUTCLK is allowed, while preventing any unwanted ringing of the output clock OUTCLK signal. As shown in the particular example of FIG. 7, the bias current is set by way of an interpolator bias voltage 62 coupled to the source terminal of each of the selection MOSFETs $Q_{S31}$-$Q_{S0}$ of the current weighting circuit of the interpolator 60. The loading bandwidth of the interpolator 60 is related to the R-C time constant associated with a resistance R, coupled between each of the output phases OUTCLKP, OUTCLKN and a drain voltage $V_{DD}$, and a load capacitance $C_L$ associated with each of the output phases OUTCLKP, OUTCLKN. The load capacitance $C_L$ is normally of function of the layout and components of the circuitry driven by the output clock phases OUTCLKP, OUTCLKN. The resistance R is normally derived from either a fixed passive component or a fixed active transistor loading circuit.

Typically, the resistance R and the load capacitance $C_L$ are fixed for a particular interpolator 60 design, thus enforcing a fixed interpolator 60 loading bandwidth. Control of the bias current is similarly limited in most cases. However, more communications systems employing a phase generator are desired to operate with a wide range of input data stream frequencies, thus making a fixed loading bandwidth and/or bias current for the interpolator less than desirable.

SUMMARY OF THE INVENTION

One embodiment of the present invention provides a bias voltage generation circuit having a voltage-to-current translation circuit configured to generate a first current that is positively related to a first voltage. A current mirror circuit is configured to generate a first bias voltage that is negatively related to the first current. The current mirror circuit also generates a second current that is positively related to the first current. Also included is a current-to-voltage translation circuit configured to generate a second bias voltage that is positively related to a second current.

In another embodiment of the invention, a method for generating first and second bias voltages is provided. A first current that is positively related to a first voltage is supplied. A first bias voltage that is negatively related to the first current is generated. Also, the first current is mirrored to yield a second current. A second bias voltage that is positively related to the second current is then produced.

Additional embodiments and advantages of the present invention will be realized by those skilled in the art upon perusal of the following detailed description, taken in conjunction with the accompanying drawings.

DETAILED DESCRIPTION OF THE INVENTION

Generally, various embodiments of the present invention provide a bias voltage generation circuit having a voltage-to-current translation circuit, a current mirror circuit, and a current-to-voltage translation circuit. The voltage-to-current translation circuit is configured to generate a first current that is positively related to a first voltage. The first current drives a current mirror, which generates both a second current that is positively related to the first current, and a first bias voltage that is negatively related to the first current. The second current then drives a current-to-voltage translation circuit to generate a second bias voltage that is positively related to the second current.

Figure 1:
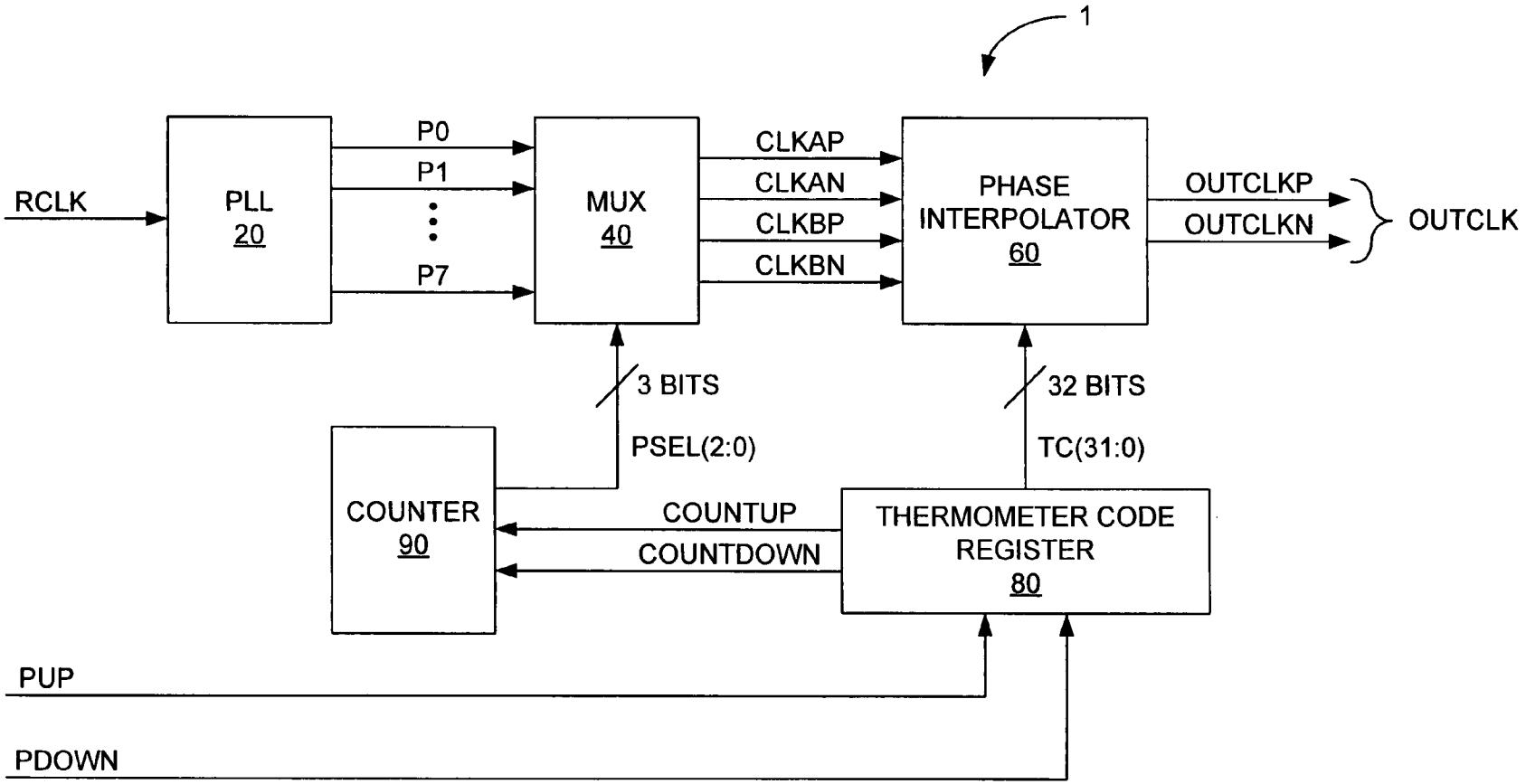
PRIOR ART FIG. 1
FIG. 1 is a block diagram of an example of a phase generator from the prior art.
Figure 2:
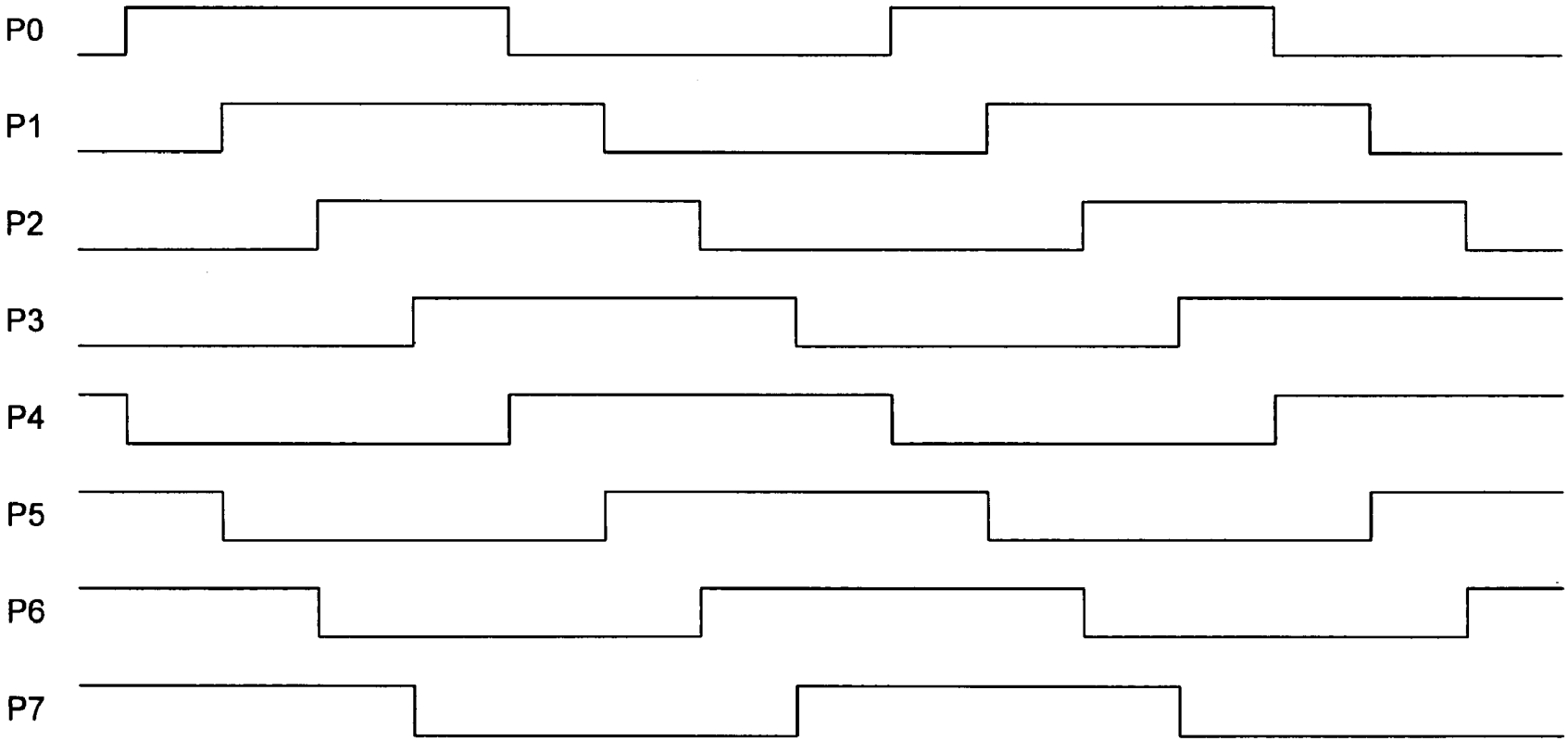
PRIOR ART FIG. 2
FIG. 2 is a timing diagram of a multiphase clock generated by a phase-locked loop (PLL) of the phase generator of FIG. 1.
Figure 3:
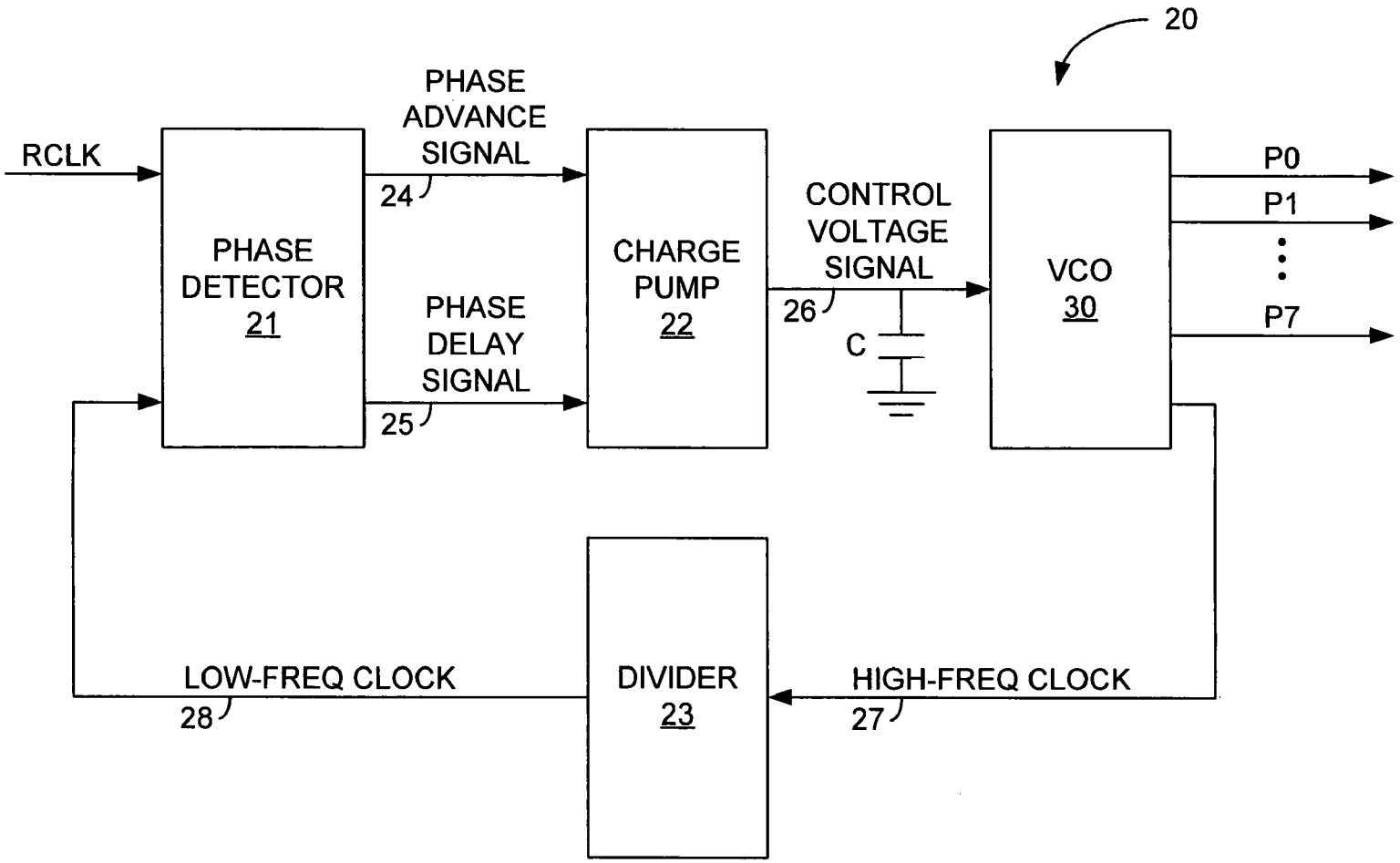
PRIOR ART FIG. 3
FIG. 3 is a block diagram of the PLL of the phase generator shown in FIG. 1.
Figure 9:
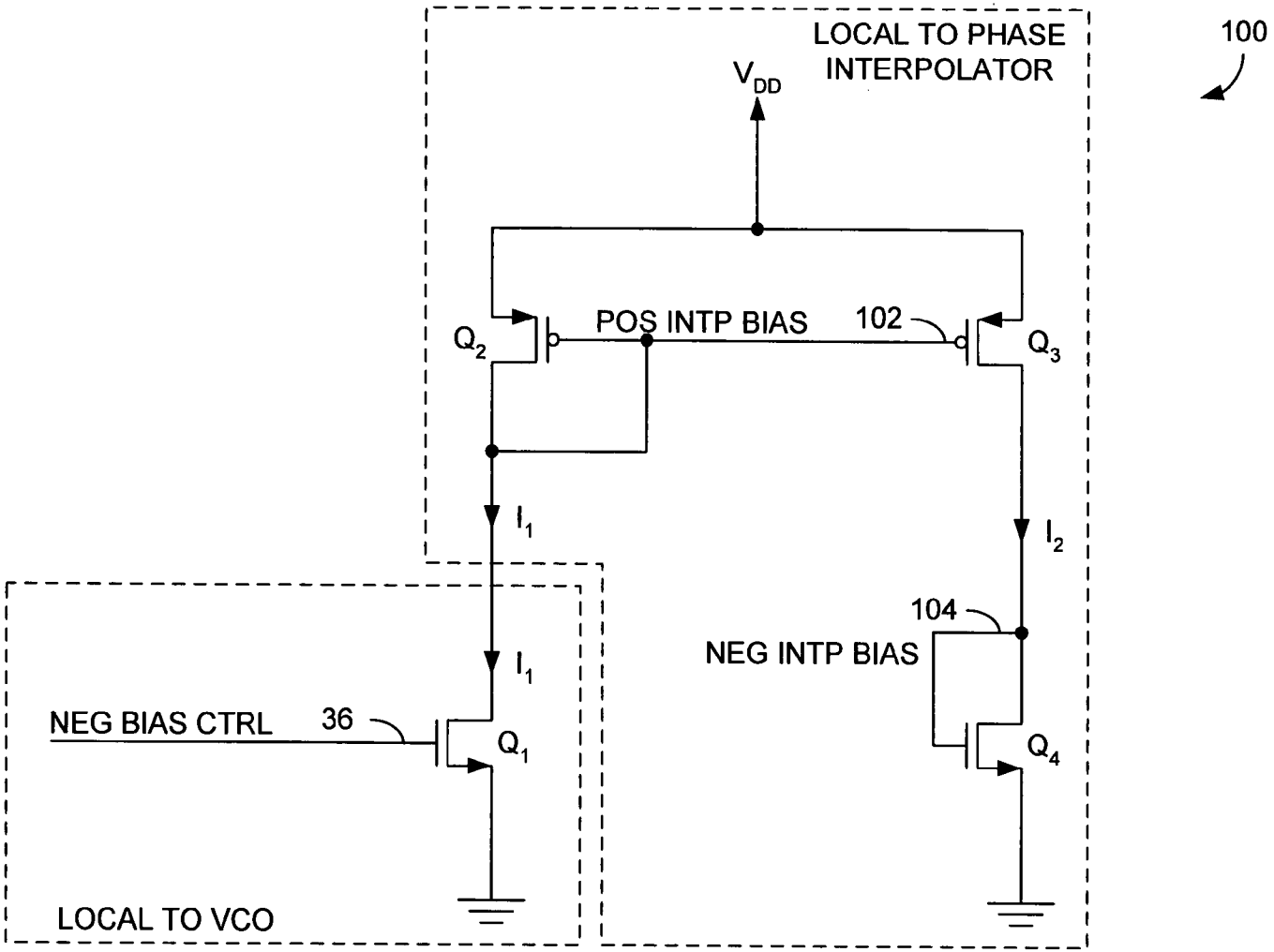
FIG. 9 is a schematic diagram of a bias voltage generation circuit according to an embodiment of the invention.

FIG. 9 provides a particular embodiment of a bias voltage generation circuit 100. While the bias voltage generation circuit 100 is presented within the environment of a phase generator, such as the phase generator 1 of FIG. 1, alternative embodiments of the invention may be employed in a variety of electronics circuits, including, but not limited to, other phase generator systems, while remaining within the scope of the invention as claimed.

Figure 4:
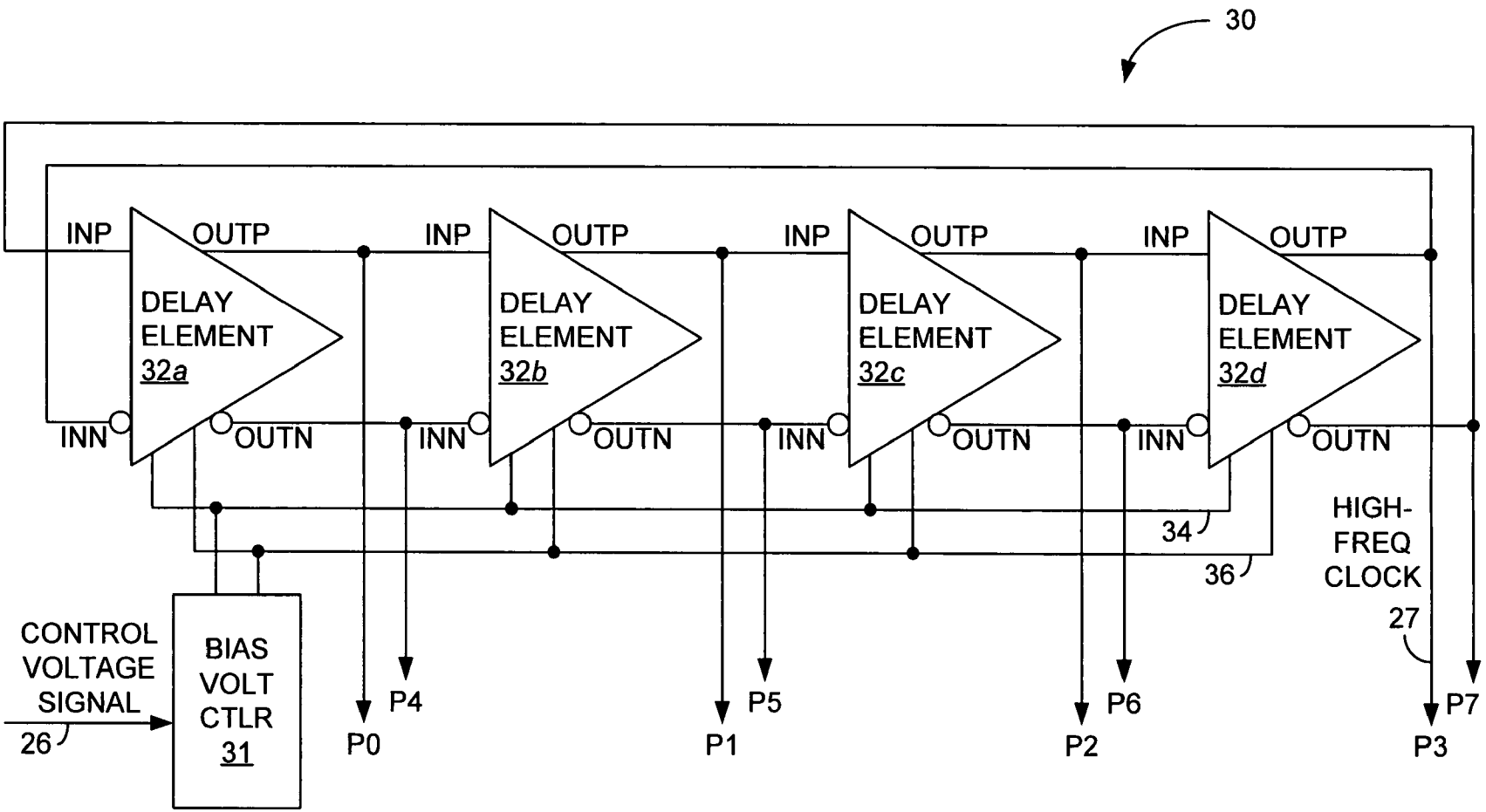
PRIOR ART FIG. 4
FIG. 4 is a block diagram of a voltage-controlled oscillator (VCO) employed by the PLL of FIG. 3.
Figure 5:
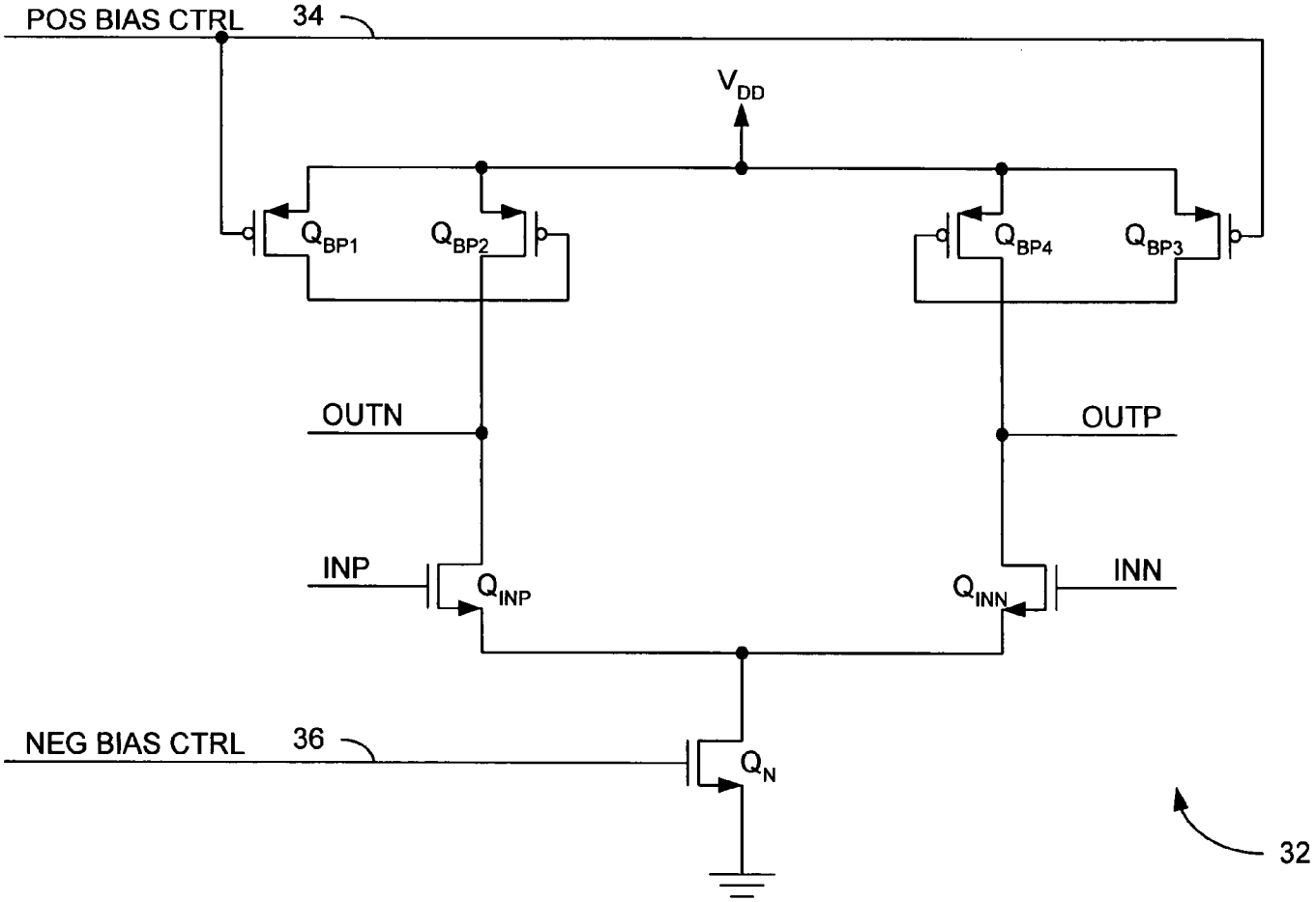
PRIOR ART FIG. 5
FIG. 5 is a simplified schematic diagram of a delay element employed within the VCO of FIG. 4.
Figure 6:
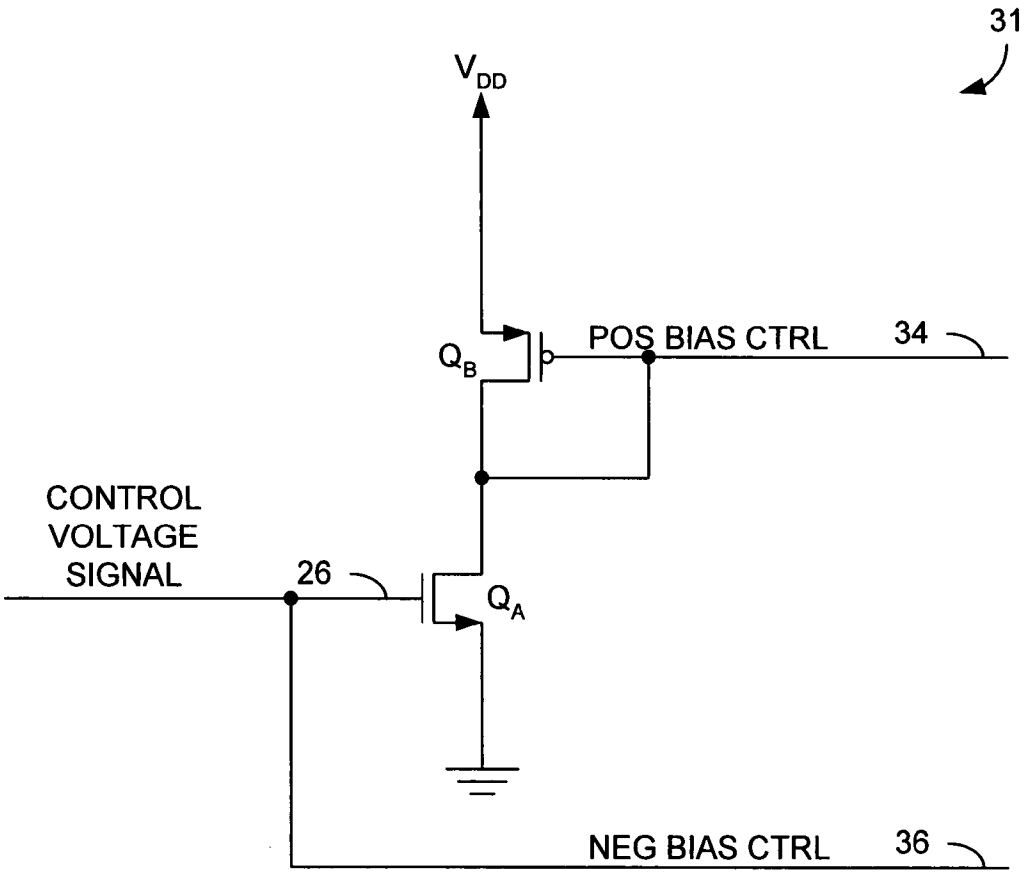
PRIOR ART FIG. 6
FIG. 6 is a simplified schematic diagram of a bias voltage controller utilized by the VCO of FIG. 4.

An n-channel metal-oxide-semiconductor field-effect transistor (MOSFET) $Q_1$ is employed as a voltage-to-current translation circuit, which converts a first voltage, such as the negative bias control signal 36 employed by the delay elements 32 of the VCO 30 shown in FIG. 4, to a first current $I_1$ that is positively related to the negative bias control signal 36. More specifically, the first current $I_1$ generally increases as the negative bias control signal 36 increases, and vice-versa. The first current $I_1$ travels from the drain to the source of $Q_1$, with the source of $Q_1$ coupled with a voltage reference, such as ground. The negative bias control signal 36 controls $Q_1$ via its gate. In other embodiments, any other voltage-oriented signal may be employed as the first voltage.

In one embodiment, $Q_1$ is located in relatively close proximity to the VCO 30 to minimize the distance over which the negative bias control signal 36 must be transmitted. Typically, voltages transferred over relatively long distances of an integrated circuit (IC) are susceptible to noise from other electronic signals or voltage references, such as ground or the drain supply voltage $V_{DD}$. As a result, the magnitude of the negative bias control signal 36 may be rendered inaccurate under such conditions. Conversely, the magnitude of an electrical current normally remains rather consistent when transferred across an IC. Thus, the first current $I_1$ is likely to experience little change in magnitude when transferred across an IC compared to the negative bias control signal 36.

The first current $I_1$ drives a current mirror circuit, which includes first and second p-channel MOSFETs $Q_2$, $Q_3$, in the particular embodiment of FIG. 9. $Q_2$ and $Q_3$ are configured as a current mirror which produces a second current $I_2$ which is positively related to the first current $I_1$. In other words, the second current $I_2$ tends to increase as the first current $I_1$ increases, and vice-versa. In one embodiment, the physical dimensions of $Q_2$ and $Q_3$ are closely matched so that the second current $I_2$ is substantially equal to the first current $I_1$. In other embodiments, the second current $I_2$ may be linearly related to the first current $I_1$. Also, other circuits performing the function of a current mirror circuit may be employed within the scope of the invention to similar end.

In FIG. 9, the drains of $Q_1$ and $Q_2$ are coupled together. The sources of both $Q_2$ and $Q_3$ are coupled with a drain voltage $V_{DD}$, and their gates are coupled together. The gate and drain of $Q_2$ are also coupled together to provide current mirroring. This connection also supplies the first bias voltage, which in the specific example of FIG. 9 is a positive interpolator bias signal 102 employed by a phase interpolator 200, which is illustrated in FIG. 10, and described in greater detail below.

The drain of $Q_3$ delivers the second current $I_2$ generated by the current mirror circuit to a current-to-voltage translation circuit, which is embodied as an n-channel MOSFET $Q_4$ as shown in FIG. 9. In that particular configuration, the gate and drain of $Q_4$ are both coupled with the drain of $Q_3$ so that the second current $I_2$ flows from the drain to the source of $Q_4$. The source of $Q_4$ is coupled with a voltage reference, such as ground. As a result of the second current $I_2$, the drain and gate of $Q_4$ produce a second bias voltage, such as a negative interpolator bias signal 104. In one embodiment, the physical dimensions of $Q_1$ and $Q_4$, as well as $Q_2$ and $Q_3$, are matched so that the negative interpolator bias signal 104 is substantially equal to the negative bias control signal 36.

Figure 7:
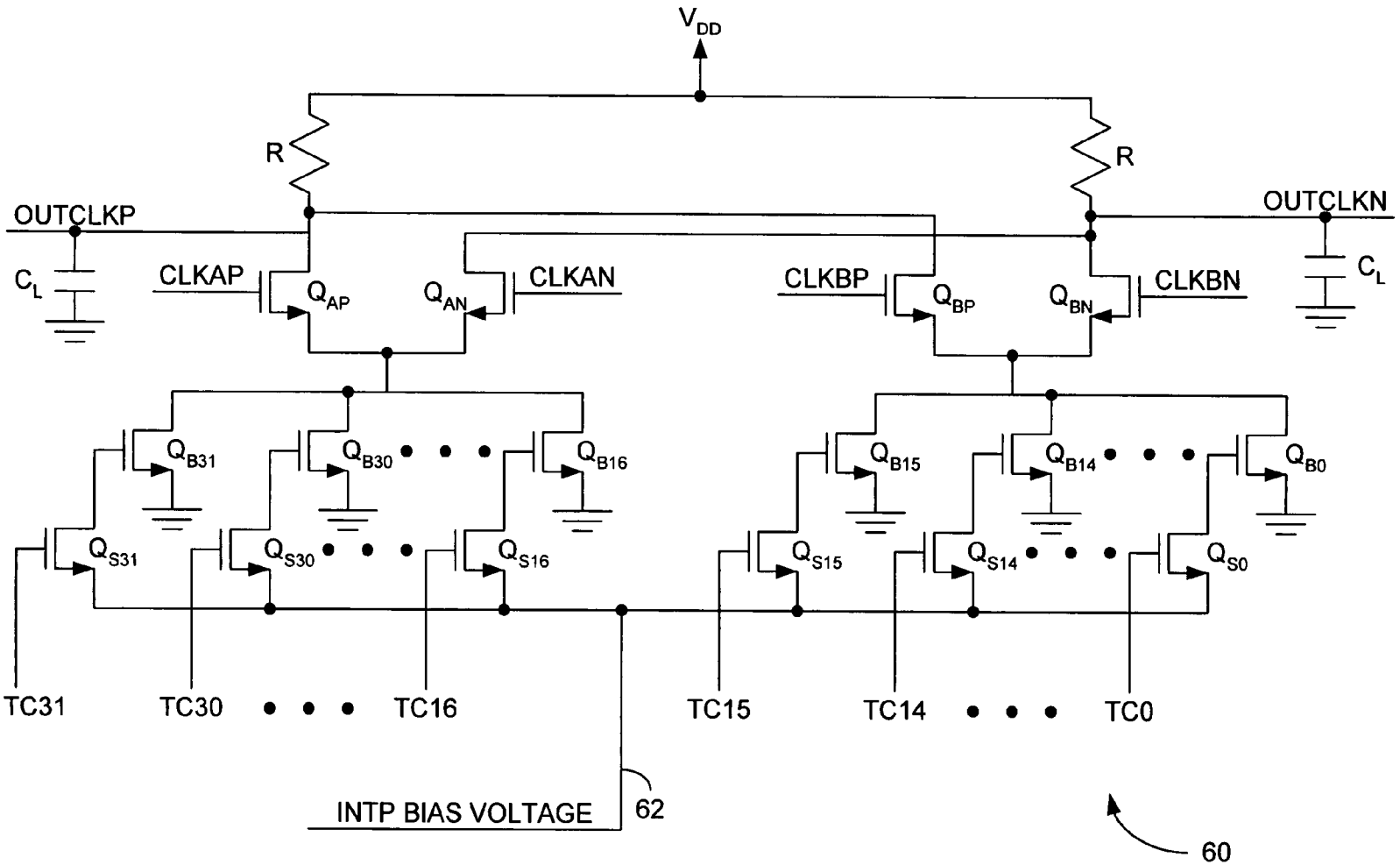
PRIOR ART FIG. 7
FIG. 7 is a simplified schematic diagram of a phase interpolator utilized by the phase generator of FIG. 1.
Figure 8:
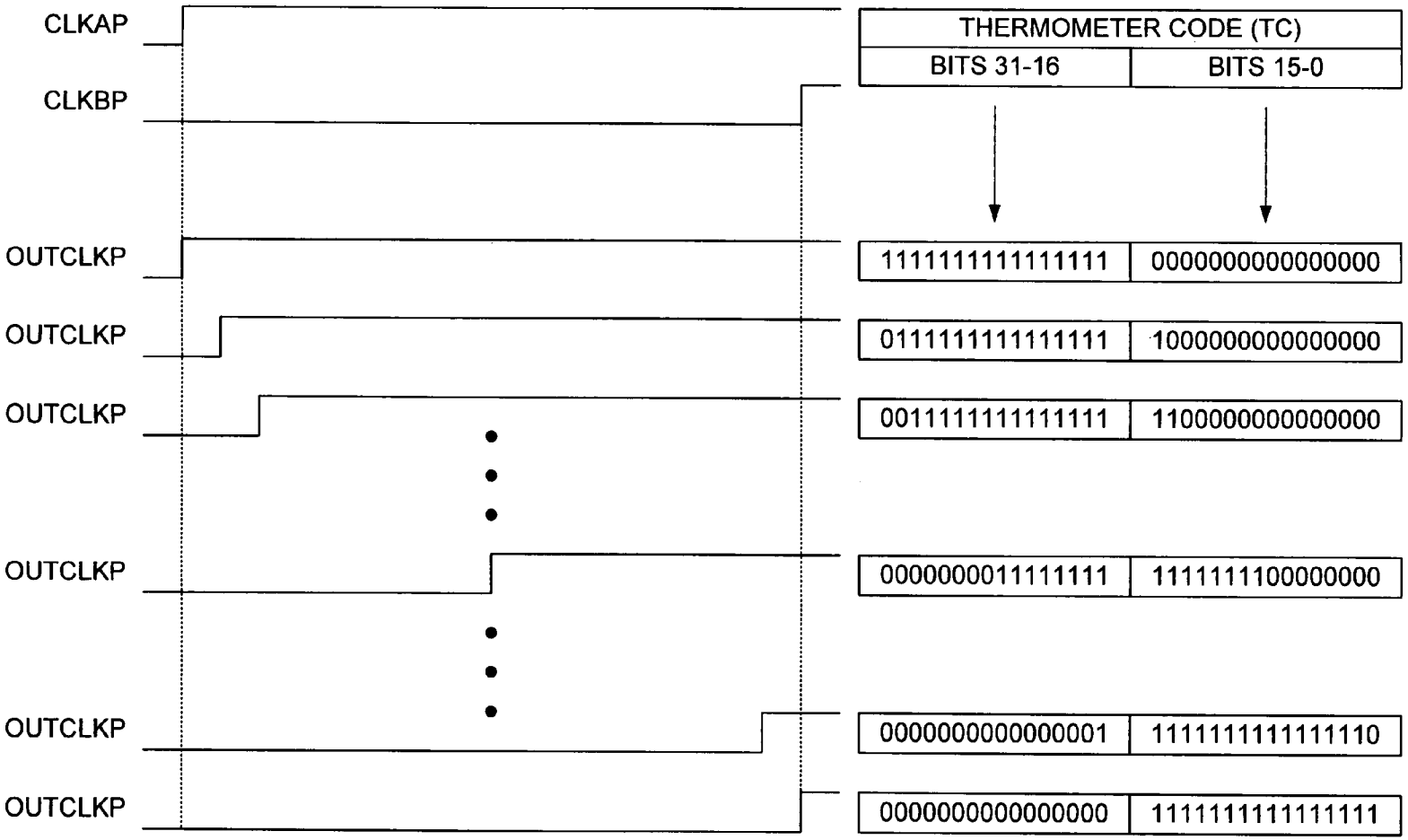
PRIOR ART FIG. 8
FIG. 8 is a timing diagram of the possible phases of the output clock generated by the phase interpolator of FIG. 7 related to selected values of a thermometer code register employed within the phase generator of FIG. 1.
Figure 10:
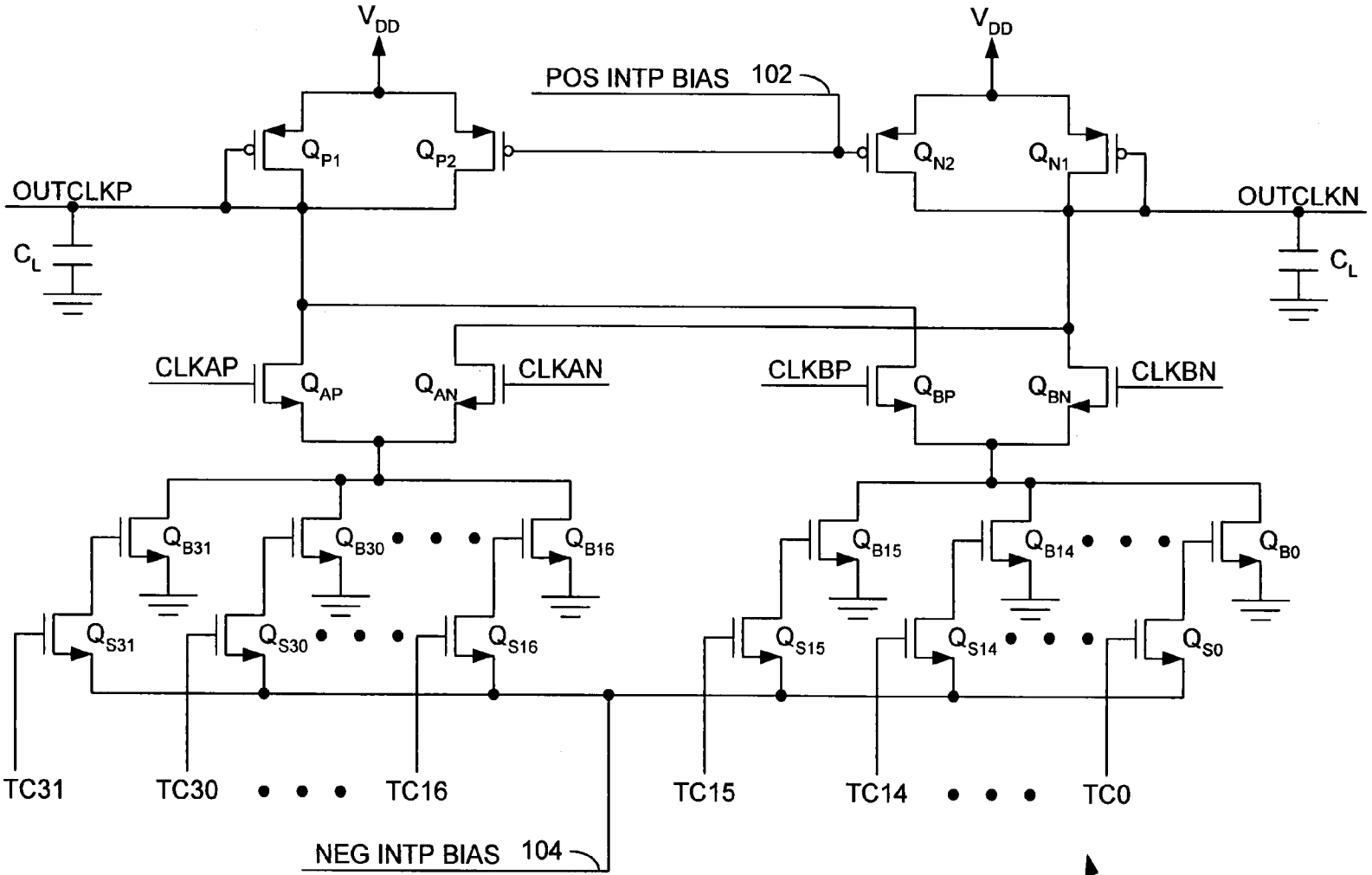
FIG. 10 is a schematic diagram of a phase interpolator employing an active resistive loading circuit controlled by a bias voltage generation circuit according to an embodiment of the invention.

As shown in the specific example of FIG. 10, the positive interpolator bias signal 102 and the negative interpolator bias signal 104 are provided to a phase interpolator 200. The negative interpolator bias signal 104 is coupled with the source of each of a set of n-channel MOSFETs $Q_{S0}$-$Q_{S31}$ employed in a current weighting circuit similar to that of the phase interpolator 60 of FIG. 7. The negative interpolator bias signal 104 thus essentially controls the bias current of the phase interpolator 200, which in turn affects the operational frequency range of the output clock phases OUTCLKP, OUTCLKN, as described above.

Similarly, the positive interpolator bias signal 102 controls the loading bandwidth of the output clock phases OUTCLKP, OUTCLKN of the interpolator 200 by way of an active resistive load circuit. Two such circuits, one per output clock phase OUTCLKP, OUTCLKN, are provided as shown in FIG. 10. For example, one resistive load circuit includes two p-channel MOSFETs $Q_{P1}$, $Q_{P2}$ which, when coupled with a load capacitance $C_L$, forms an R-C circuit that determines the loading bandwidth of the positive output clock phase OUTCLKP. The drains of $Q_{P1}$ and $Q_{P2}$ are coupled with the output OUTCLKP, along with the gate of $Q_{P1}$. The gate of $Q_{P2}$ is driven by the positive interpolator bias signal 102 to control the resistive load formed by $Q_{P1}$ and $Q_{P2}$, thus altering the loading bandwidth of the positive output clock phase OUTCLKP. Similarly, two MOSFETs $Q_{N1}$, $Q_{N2}$ are employed to adjust the loading bandwidth of the negative output clock phase OUTCLKN.

Given the particular examples described above, the bias current and output loading bandwidth of the phase interpolator 200 may be adjusted in accordance with changes in frequency of a local reference clock, as evidenced by a bias control voltage, such as the negative bias control 36 of a delay element 32 employed by a VCO. Thus, embodiments of the invention as described herein provide automatic adjustment of the operating bandwidth of phase interpolator by tracking changes in the frequency of a reference clock, such as the reference clock RCLK of the phase generator 1 shown in FIG. 1.

Figure 11:
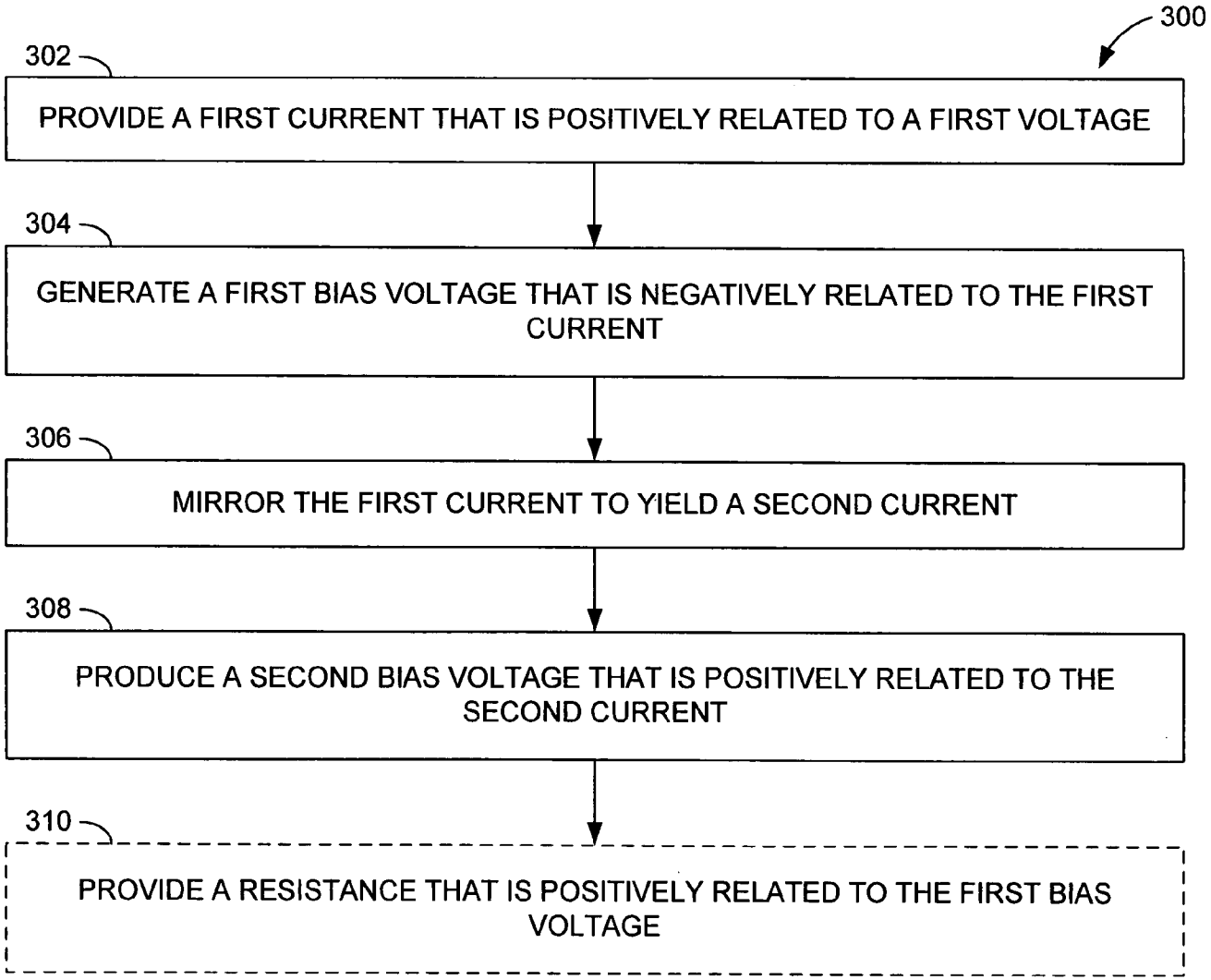
FIG. 11 is a flow chart of a method according to an embodiment of the invention for generating first and second bias voltages.

Embodiments of the invention may also take the form of a method 300 for generating first and second bias voltages, as illustrated in the block diagram of FIG. 11. A first current positively related to a first voltage is provided (operation 302). In other words, the first current generally increases as the first voltage increases, and vice-versa. A first bias voltage being negatively related to the first current is generated (operation 304). More specifically, the first bias voltage generally decreases as the magnitude of the first current falls, and vice-versa. The first current is also mirrored to yield a second current (operation 306). In one particular example, the second current is essentially equal to the first current. In other embodiments, the second current may be linearly related to the first current. A second bias voltage that is positively related to the second current is produced (operation 308). In addition, a resistance which is positively related to the first bias voltage may then be provided (operation 310). Such a method 300 may be employed by a phase interpolator to control bias current and loading bandwidth, as described above.

While several embodiments of the invention have been discussed herein, other embodiments encompassed by the scope of the invention are possible. For example, while some embodiments of the invention as described above are specifically employed within the environment of a phase generator employing a PLL and a phase interpolator for data clock recovery, these embodiments are provided for the purpose of explaining embodiments of the invention within a working system. Thus, other electronic circuits requiring bias voltage generation based upon a given voltage signal may benefit from the various embodiments. Also, while specific components, such as n-channel and p-channel MOSFETs, have been employed in the embodiments disclosed above, alternative embodiments utilizing other types of transistors, such as bipolar junction transistors (BJTs), or other components, are also possible. Further, aspects of one embodiment may be combined with those of alternative embodiments to create further implementations of the present invention. Thus, while the present invention has been described in the context of specific embodiments, such descriptions are provided for illustration and not limitation. Accordingly, the proper scope of the present invention is delimited only by the following claims.

What is claimed is:

1. A bias voltage generation circuit for a phase interpolator, the bias voltage generation circuit comprising:

a voltage-to-current translation circuit configured to generate a first current that is positively related to a first voltage;

a current mirror circuit configured to generate a first bias voltage that is negatively related to the first current, and configured to generate a second current that is positively related to the first current;

a current-to-voltage translation circuit configured to generate a second bias voltage that is positively related to the second current; and a resistive load circuit configured to provide a resistance coupled with an output clock signal of the phase interpolator;

wherein the first bias voltage controls the resistive load circuit; and wherein the second bias voltage controls a current weighting circuit of the phase interpolator.

2. The bias voltage generation circuit of claim 1, wherein the resistance is positively related to the first bias voltage.

3. The bias voltage generation circuit of claim 1, wherein the current mirror circuit and the current-to-voltage translation circuit are physically located closer to the phase interpolator than is the voltage-to-current translation circuit.

4. The bias voltage generation circuit of claim 1, wherein a magnitude of the second current is equal to a magnitude of the first current.

5. The bias voltage generation circuit of claim 1, wherein a magnitude of the second bias voltage is equal to a magnitude of the first voltage.

6. The bias voltage generation circuit of claim 1, wherein the first voltage is a bias control signal of a voltage-controlled oscillator.

7. The bias voltage generation circuit of claim 1, the voltage-to-current translation circuit comprising:

an n-channel metal-oxide-semiconductor field-effect transistor (MOSFET) comprising a gate coupled with the first voltage, a drain coupled with the current mirror circuit, and a source coupled with a voltage reference.

8. The bias voltage generation circuit of claim 1, the current mirror circuit comprising:

a first p-channel MOSFET comprising a gate and a drain coupled with the voltage-to-current translation circuit, and a source coupled with a drain voltage; and a second p-channel MOSFET comprising a gate coupled with the gate of the first p-channel MOSFET, and a source coupled with the drain voltage;

wherein the drain of the first p-channel MOSFET produces the first bias voltage.

9. The bias voltage generation circuit of claim 1, the current-to-voltage translation circuit comprising:

an n-channel MOSFET comprising a gate and a drain coupled with the current mirror circuit, and a source coupled with a voltage reference;

wherein the gate and the drain produce the second bias voltage.

10. The bias voltage generation circuit of claim 1, the resistive load circuit comprising:

a first p-channel MOSFET comprising a gate and a drain coupled with the output, and a source coupled with a drain voltage; and a second p-channel MOSFET comprising a gate driven by the first bias voltage, a drain coupled the drain of the first p-channel MOSFET and a source coupled with the drain voltage.

11. The bias voltage generation circuit of claim 1, further comprising the phase interpolator.

12. A phase generator comprising the bias voltage generation circuit of claim 11.

13. A method of generating a first and second bias voltages for a phase interpolator, comprising:

providing a first current that is positively related to a first voltage;

generating the first bias voltage, the first bias voltage being negatively related to the first current;

applying a resistance to an output clock signal of the phase interpolator, wherein the resistance is controlled via the first bias voltage;

mirroring the first current to yield a second current;

producing the second bias voltage, the second bias voltage being positively related to the second current; and controlling a current weighting circuit of the phase interpolator via the second bias voltage.

14. The method of claim 13, wherein the resistance is positively related to the first bias voltage.

15. The method of claim 13, wherein a magnitude of the second current is equal to a magnitude of the first current.

16. The method of claim 13, wherein a magnitude of the second bias voltage is equal to a magnitude off the first voltage.

17. The method of claim 13, wherein the first voltage is a bias control signal or a voltage-controlled oscillator.

18. A phase interpolator employing the method of claim 13.

19. A phase generator comprising the phase interpolator of claim 18.

20. A bias voltage generation circuit for a phase interpolator, the bias voltage generation circuit comprising:

means for providing a first current positively related to a first voltage;

means for creating a second current positively related to the first current, the creating means also yielding a first bias voltage which is negatively related to the first current;

a resistance coupled with an output clock signal of the phase interpolator, wherein the resistance is controlled by the first bias voltage; and means for producing a second bias voltage which is positively related to the second current, wherein the second bias voltage controls a current weighting circuit of the phase interpolator.

21. The bias voltage generation circuit of claim 20, wherein the resistance is positively related to the first bias voltage.

22. The bias voltage generation circuit of claim 20, wherein a magnitude of the second current is equal to a magnitude of the first current.

23. The bias voltage generation circuit of claim 20, wherein a magnitude of the second bias voltage is equal to a magnitude of the first voltage.

24. The bias voltage generation circuit of claim 20, wherein the first voltage is a bias control signal of a voltage-controlled oscillator.

25. The bias voltage generation circuit of claim 20, further comprising the phase interpolator.

26. A phase generator comprising the bias voltage generation circuit of claim 25.

* * * * *

UNITED STATES PATENT AND TRADEMARK OFFICE

CERTIFICATE OF CORRECTION

PATENT NO. : 7,816,975 B2
APPLICATION NO. : 11/230786
DATED : October 19, 2010
INVENTOR(S) : Dacheng Zhou et al.

It is certified that error appears in the above-identified patent and that said Letters Patent is hereby corrected as shown below:

In column 10, line 28, in Claim 10, delete "coupled the" and insert -- coupled with the --, therefor.

In column 10, line 29, in Claim 10, delete "MOSFET" and insert -- MOSFET, --, therefor.

In column 10, line 54, in Claim 16, delete "off" and insert -- of --, therefor.

In column 10, line 57, in Claim 17, delete "or" and insert -- of --, therefor.

Signed and Sealed this
Eighth Day of March, 2011

David J. Kappos

David J. Kappos
*Director of the United States Patent and Trademark Office*